United States Patent [19]

Kaliski

[11] Patent Number: 4,851,632

[45] Date of Patent: Jul. 25, 1989

[54] INSULATED FRAME PACKAGE FOR MICROWAVE COOKING

[75] Inventor: Edward J. Kaliski, Greenville, Del.

[73] Assignee: E. I. Du Pont de Nemours and Company, Wilmington, Del.

[21] Appl. No.: 245,153

[22] Filed: Sep. 16, 1988

[51] Int. Cl.[4] ..... H05B 6/64

[52] U.S. Cl. ..... 219/10.55 E; 219/10.55 F; 426/107; 426/110; 426/113; 426/243; 206/466; 229/125.35; 99/DIG. 14

[58] Field of Search ..... 219/10.55 E, 10.55 F; 426/106, 107, 110, 113, 126, 241, 243, 234; 206/463, 466, 484; 229/87 F, 125.35; 99/451, DIG. 14

[56] References Cited

U.S. PATENT DOCUMENTS

| | | | |
|---|---|---|---|
| 3,395,025 | 7/1968 | Hermanson | 426/113 X |
| 4,267,420 | 5/1981 | Brastad | 219/10.55 E |
| 4,641,005 | 2/1987 | Seiferth | 219/10.55 E |
| 4,713,510 | 12/1987 | Quick et al. | 219/10.55 E |
| 4,735,513 | 4/1988 | Watkins et al. | 383/116 |

*Primary Examiner*—A. D. Pellinen
*Assistant Examiner*—David Osborn

[57] ABSTRACT

A film package is provided for containing, heating, and browning or crispening a food item, which has a microwave susceptor-containing film and an insulating layer between regions of the film laden with susceptor which are in proximity with each other. The insulating layer prevents the susceptor laden areas in proximity with each other from overheating.

14 Claims, 3 Drawing Sheets

INSULATED FRAME PACKAGE FOR MICROWAVE COOKING

BACKGROUND OF THE INVENTION

This invention relates to packaging materials useful for microwave cooking applications, and particularly to packaging materials which will brown and crispen food items without overheating and degradation of the seams of such packages.

There has been much interest recently in packaging materials which aid in browning and crispening of food items in a microwave oven. U.S. Pat. No. 4,267,420, to Brastad, discloses a food item wrapped with plastic film having a very thin coating thereon. The film conforms to a substantial portion of the food item. The coating converts some of the microwave energy into heat which is transmitted directly to the surface portion of the food so that a browning and/or crispening is achieved.

U.S. Pat. No. 4,641,005, Seiferth, discloses a disposable food receptacle for use in microwave cooking, which includes a provision to brown the exterior of the food in the receptacle. A thin layer of an electrically conductive material is incorporated into the receptacle on the food contacting surfaces thereof, so that the conductive layer will become heated by the microwave radiation and will, in turn, brown the exterior of the food in the receptacle. The receptacle includes a smooth surfaced plastic film, as a protective layer, and a support means formed of paper stock material.

U.S. Pat. No. 4,713,510, Quick et al., discloses a microwave ovenable package including a layer of material that will convert a portion of the microwave energy to heat and a layer of paperboard interposed between the energy-converting layer and the food. The energy-converting layer may be carried on a plastic film, and an additional layer of paperboard may be used to sandwich the energy-converting layer and the plastic film between layers of paperboard. For the purpose of providing a more intense heating effect, two energy-converting layers, each on a dielectric substrate, sandwiched together between layers of paperboard, are disclosed.

U.S. Pat. No. 4,735,513, Watkins et al., discloses a flexible sheet structure comprising a base sheet having a microwave coupling layer which may be in the form of an island covering a selected area of the sheet. The sheet may be laminated to a backing sheet of dimensionally stable flexible material transparent to microwaves; backing sheets can be applied to both sides of the base sheet. The structure may have unheated portions which are adapted to be folded, tucked, and wrapped around a product to be heated.

Copending U.S. patent application Ser. No. 188,556 discloses a conformable laminated wrap for packaging articles of food requiring browning and crispening and a degree of shielding during microwave cooking. The laminated wrap has at least two layers of heat resistant microwave transparent plastic film, and at least one substantially continuous layer of microwave susceptive material, which is coated on at least one of the interior surfaces or interfaces formed between the plastic films of the laminate.

In packages suitable for browning or crispening food in a microwave oven, seals or seams may be present and microwave susceptive heating materials may be present near or as a part of the seal. Alternatively, areas of a microwave package coated with a microwave susceptor may be located in contact with each other, yet not in close contact with food. A problem is often encountered with overheating and in severe cases even melting of the film in such areas where there is no close contact with food to act as a heat sink. Melting of the polymer can cause the package to deform and the layers of film to adhere together, and in severe cases may even cause contamination of the food with molten polymer. The present invention avoids these problems by affixing the layers of film to a microwave inert insulating material, rather than directly to each other. In a preferred embodiment, the insulating layer is a cardboard frame surrounding the food, to which upper and lower films are sealed.

SUMMARY OF THE INVENTION

The present invention provides a microwave cooking package suitable for cooking a food item which requires surface browning or crispening, comprising (a) an upper leaf and a lower leaf formed from at least one heat resistant film, said film having a microwave susceptor material extending over at least a portion of its surface area in an amount to generate sufficient heat under microwave cooking conditions to brown or crispen the surface of said food item placed adjacent thereto, said upper and lower leaves being maintained in proximity with each other in an area about the periphery of such upper and lower leaves so as to form a container of a size and shape suitable for enclosing said food item, wherein said susceptor material extends over at least a portion of the areas in proximity with each other; and (b) a thermally insulating, microwave transparent material to which at least a portion of said susceptor-laden areas in proximity with each other are affixed, whereby direct contact between said portions of susceptor-laden areas in proximity with each other is avoided and said portions do not overheat during microwave cooking.

DETAILED DESCRIPTION OF THE INVENTION

Figure 1:
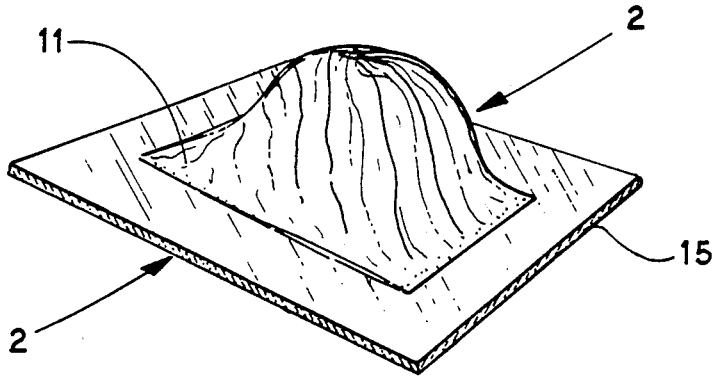
FIG. 1 shows one embodiment of the package of the present invention.

The present invention comprises a heat resistant film structure which forms a package suitable for containing, browning, and crispening a food item in a microwave oven. The base film of the structure is a heat resistant, microwave transparent plastic film. This film may be made from any suitable plastic film which has the desired properties of heat resistance and microwave transparency. The term "heat resistant" refers to the ability of the film to withstand the temperatures generated in a 700 watt microwave oven during cooking without melting or degrading when in contact with a food item. When the film is made into the package of the present invention, temperatures of up to about 220° C. or more may be encountered under microwave cooking conditions, so the film should maintain its integrity at such temperatures. Certain polyesters, such as polyethylene terephthalate (PET), having a melting point of about 260° C., are particularly suitable for this purpose. Other suitable materials may include certain types of polyesters, polyamides, cellophane, cellulose triacetate, ethylene chlorotrifluoroethylene copolymers, fluorinated polyethylene, polyimides, polysulfones, polyvinyl alcohol polymers, polyetheretherketones, polytetrafluoroethylene, and others.

The heat resistant base film is provided with a microwave susceptive material in the form of a coating or layer which extends over at least a portion of its surface area. The coating may be of any material suitable for conversion of at least a portion of incident microwave radiation to heat. For example, the susceptive material can be in the form of a coating of (i) about 5 to 80% by weight of metal or metal alloy susceptor in flake form, embedded in (ii) about 95 to 20% by weight of a thermoplastic dielectric material. More preferably the relative amount of such susceptor will be about 25 to 80% by weight, and most preferably about 30 to 60% by weight. A coating thicknesses of about 0.01 mm to about 0.25 mm (about 0.4 to 10 mils) is suitable for many applications. The surface weight of such a susceptor coating on the substrate is from about 2.5 to 100 $g/m^2$, preferably about 10 to about 85 $g/m^2$.

Suitable thermoplastic dielectric materials in which the susceptor flake may be embedded include, but are not limited to, polyesters selected from the group consisting of copolymers of ethylene glycol, terephthalic acid, and azelaic acid; copolymers of ethylene glycol, terephthalic acid, and isophthalic acid; and mixtures of these copolymers.

Suitable susceptor flake materials for use in this embodiment of the invention include aluminum, nickel, antimony, copper, molybdenum, iron, chromium, tin, zinc, silver, gold, and various alloys of these metals. Preferably the susceptor flake material is aluminum. The flakes of the susceptor should have an aspect ratio of at least about 10, and will preferably have a diameter of about 1 to about 48 micrometers, and a thickness of about 0.1 to about 0.5 micrometers. In order to obtain uniformity in heating, it is preferred that the flakes be approximately circular, having an ellipticity in the range of about 1:1 to 1:2. Alternatively, the flakes, if not circular, can be applied to the film in two or more separate passes at right angles to each other, which also provides an improvement in the degree of uniformity of heating. Films prepared from such material will typically have a surface resistance of at least $1\times10^6$ ohms per square, and are normally optically opaque. Such films are described in more detail in copending U.S. application Ser. No. 002,980, filed Jan. 20, 1987, the disclosure of which is incorporated herein by reference.

Alternatively, the base film can be coated with a thin layer of susceptor material by vacuum deposition techniques. In this embodiment, the susceptor material can be a substantially continuous electrically conductive material which is present in sufficient thickness to cause the multilayer structure to heat under microwave cooking conditions to a temperature suitable for browning or crispening of food placed adjacent thereto, but not so thick as to completely prevent penetration of microwave energy to the interior of the food. A preferred susceptor material is vacuum metallized aluminum, which will preferably be present in sufficient amounts to impart an optical density of about 0.10 to about 0.35, preferably 0.16 to about 0.22, to the film. Other metals, of course, may be used, including gold, silver, mumetal, stainless steel, nickel, antimony, copper, molybdenum, bronze, iron, tin, and zinc. Methods other than vacuum deposition may also be used if they provide a substantially continuous layer of the desired thickness.

The amount of susceptor material applied to the film, whether metal flake, continuous metallized layer, or other material, may be varied within certain limits which will be apparent to one skilled in the art. The test to determine the correct amount of material is whether the coating will heat to the proper temperature and provide sufficient heat flux for browning or crispening of food items. The required temperature may depend on the particular food item used but for many applications is at least about 180° C.

It is preferred that the film of the present invention be a laminate comprising at least one layer of heat stable resin and at least a second layer of resin. The susceptor material is located on an interior surface of at least one layer of the laminate. Such laminates are more fully described in copending U.S. application Ser. No. 188,556, filed Apr. 29, 1988, the disclosure of which is incorporated herein by reference. The presence of such a heat stable resin layer in a laminated structure provides a limited, controlled amount of shrinkage to the film. Particularly preferred for this layer is heat stabilized polyethylene terephthalate. Heat stabilized PET is made from a regular grade of PET film by a stabilization process involving a series of heat treatment and relaxation steps, and is well known to those skilled in the art. A heat stabilization process for PET is more fully described in Bulletin E-50542, "Thermal Stabilization of Mylar ®," from E. I. Du Pont de Nemours and Company. Heat stable films, of course, may include films other than heat stabilized PET, including those listed above, provided such films have the desirable property of minimal shrinkage under microwave cooking conditions.

The film used for the present invention will preferably also include a layer of a relatively low melting thermoplastic material over at least a part of its surface, suitable for sealing the film to form a package. Suitable materials include polyesters selected from the group consisting of copolymers of ethylene glycol, terephthalic acid, and azelaic acid; copolymers of ethylene glycol, terephthalic acid, and isophthalic acid; and mixtures of these copolymers.

The susceptor material may extend over the entire surface area of the film, or it may be limited to certain selected areas. For example, if the film is prepared as a roll of film, it may be convenient to provide the susceptor material as a stripe of an appropriate width down the middle of the film. In the package of this invention, the film comprises an upper leaf and a lower leaf, in substantial proximity or contact with the upper and lower surfaces of the food to be heated, respectively. In this way the heat generated by the susceptor materials is efficiently transferred to the surface of the food. Of course, the terms "upper" and "lower" as used herein are relative, and may equally well be "front" and "back" or "left" and "right," etc., depending on the orientation of the package.

In addition to a susceptor laden film, the package also comprises an insulating material. The insulating material extends throughout at least a portion of the areas of the upper and lower leaves of the heat resistant film in which microwave susceptor material of one leaf is in proximity to susceptor material of the other leaf. The insulating material may be any material of suitable insulating capacity to thermally isolate the two leaves of film and sufficient thermal mass to prevent the film in contact therewith from overheating. It has been found that a layer of cardboard functions quite effectively, although other materials, such as polytetrafluoroethylene or other polymeric materials of sufficient thickness and temperature resistance would also be suitable. The insulating material should normally be made of a material which will not melt upon exposure to the temperatures encountered during microwave heating, although it is possible that under some circumstances even melting might be desirable. It is believed that the insulating material can act as a heat sink to aid in dissipation of excess heat generated from the films, and thus prevents the films themselves from melting.

In one particularly preferred embodiment, the insulating material is a substantially planar frame which encompasses the food item to be packaged and cooked. Such an embodiment is illustrated in FIG. 1. The package comprises an upper leaf of heat resistant film, 11, and a lower leaf not visible. As illustrated in FIG. 1, the microwave susceptor extends throughout the entire surface area of the upper and lower leaves. The two leaves are secured around their edges, face to face, to an insulating layer, 15, which in this case may be a frame made of e.g. cardboard which surrounds a food item (not visible) enclosed between upper and lower leaves of film.

Figure 2:
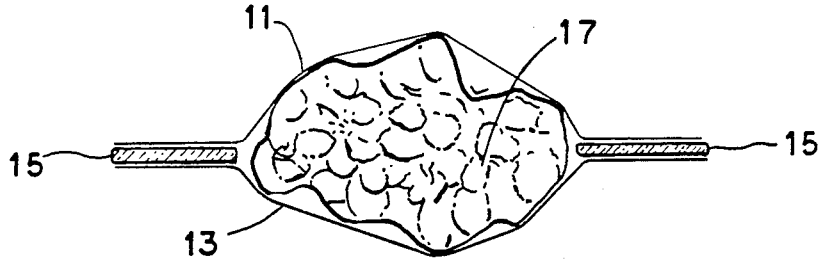
FIG. 2 shows a cross section of the package of FIG. 1.

A more detailed view is shown in FIG. 2, which is a sectional view taken along line 2—2 of FIG. 1. In this drawing the food item, 17, is visible between the upper and lower layers of film, 11 and 13. The insulating layer, 15, is seen sandwiched between the upper and lower films. The insulating layer is of an appropriate size and shape to keep the upper and lower films separate from each other so that they are in contact only with the food item or with the insulating layer.

The upper and lower leaves are secured to the insulating material by any appropriate means, including mechanical means, but are preferably sealed thereto by means of an adhesive or a relatively low melting heat sealable material such as that described above. The seal may be formed by heating the seal areas with a hot iron, or by other means.

Figure 3:
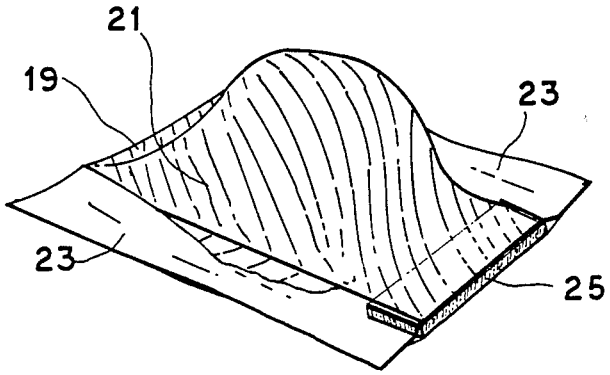
FIG. 3 shows an alternative package of the present invention.

Alternatively, the susceptor material need not extend over the entire surface area of the two leaves of film of the package. Such a package is shown in FIG. 3, and may be formed, for example, by folding on itself at crease 19 a single sheet of film having a susceptor stripe, 21, along its length, and susceptor-free areas, 23, along its edges. In such a package the susceptor free-edges may be sealed together directly, and the end opposite the crease, which is the area where susceptor material is present, can be secured to an insulating layer, 25, which extends through only that part of the package where the film needs protection from overheating.

Figure 4:
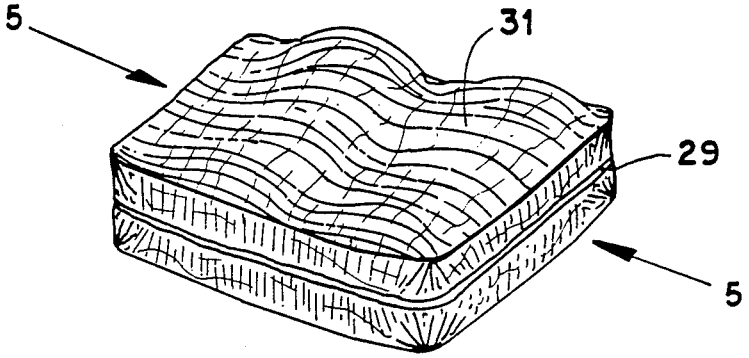
FIG. 4 shows another alternative package of the present invention.
Figure 5:
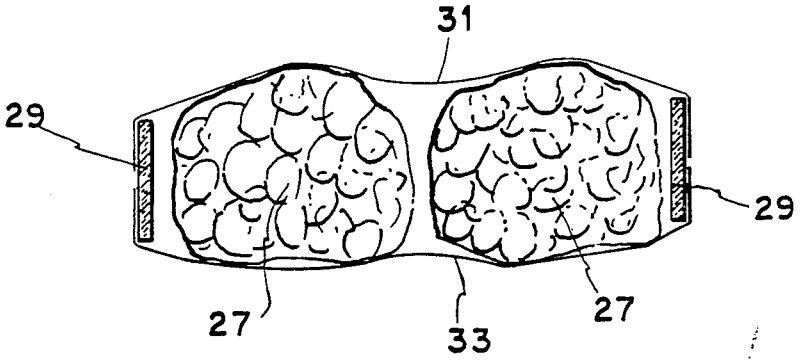
FIG. 5 shows a cross section of the package of FIG. 4.

In yet another embodiment, the insulating material is in the form of a wall or fence at least partially surrounding the food item, as shown in FIGS. 4 and 5. In this package, the food item or items, 27, are surrounded by a vertical fence, 29, of an appropriate insulating material, such as cardboard. (The term "vertical" is also used in a relative sense and depends on the orientation of the package. The fence is more or less perpendicular to the plane defined by the upper and lower leaves of film.) Above and below the food items are the upper and lower leaves of susceptor-laden film, 31 and 33, which extend over the edge of the fence and are affixed thereto, for example, by a layer of adhesive material (not shown). In this embodiment the edges of the film are affixed to the insulating material and abut each other in an edge-to-edge fashion, without overlapping each other and without the consequent problems of overheating. In abutting each other, the upper and lower layers of film may actually be in contact edge to edge or a gap of a greater or lesser extent may remain between them.

Figure 6:
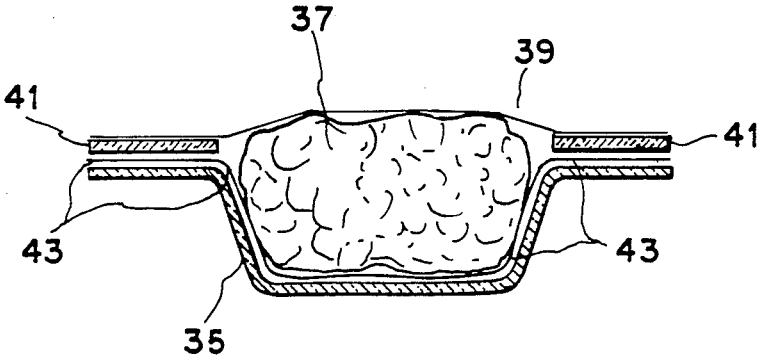
FIG. 6 shows yet another alternative package of the present invention, in cross section.

In another embodiment, one or more pieces of the susceptor-laden film may be laminated or otherwise affixed to a stiff substrate, such as paperboard or cardboard. A package formed thereby may be less completely conformable to food items than a package in which the film forms an unsupported pouch, but for some applications such increased rigidity may be desirable. This alternative embodiment is illustrated in FIG. 6, which shows a cross-sectional view of such a package. The lower microwave susceptor film, 43, is secured or positioned within a cardboard form, 35, optionally by means of an adhesive layer (not shown). Food item 37 is substantially contained in the cavity formed by the and cardboard form 35. An upper microwave susceptor film, 39, covers the food item and meets the lower film 43 around the edges of the food item. As in other embodiments of this invention, an insulating material, 41, is interposed between the upper and lower leaves of the microwave susceptor film where the leaves would otherwise contact each other. Thus overheating in these areas is avoided.

In practice, a package of the present invention, containing a food item to be browned or crispened is placed into a microwave oven, which is then energized for an appropriate amount of time, depending on the cooking results desired. The package configuration may include sufficient film to allow for expansion of the food product during cooking. The microwave susceptor material in the films generates heat which serves to brown or crispen the surface of the food, while penetration or microwave energy cooks the interior of the food. The insulated seal area remains intact without melting during the cooking process, providing uniformly cooked foods, as illustrated in the examples which follow.

EXAMPLES

Example 1

A package is prepared containing six uncooked buttermilk biscuits, using "Poppin' Fresh TM" brand dough from Pillsbury (raw dough sold refrigerated in a sealed tube under some pressure). A cardboard frame is placed around the biscuits, which are arranged side by side, and a leaf of microwave heating film is sealed to the top and one to the bottom sides of the frame to form a package similar to that of FIG. 1. The microwave heating film is a laminate prepared from two outer layers of heat stablized PET film about 0.012 mm thick (from Toyobo) and one inner layer of PET film of similar thickness which is vacuum metallized with aluminum to an optical density of 0.16 to 0.20. An adhesive ("Adcote" 506-40, a cross-linkable copolyester from Morton Thiokol) is used to secure the layers to each other. To an outer surface of the laminate is applied a layer of heat sealable polyester resin, the condensation product of 1.0 mol ethylene glycol with 0.53 mol terephthalic acid and 0.47 mol azelaic acid, also containing small amounts of erucamide and magnesium silicate. (This same sealable polyester resin composition can also be used as the adhesive layer to secure the layers to each other.) Such laminates are described in more detail in U.S. application Ser. No. 188,556, filed Apr. 29, 1988. The film is sealed to the cardboard frame by selectively applying a hot iron to melt the heat sealable polyester layer to the frame. The package containing the biscuits is placed into a 700 W "Sharp" microwave oven and cooked on "high" for 140 to 150 seconds. The experiment is run two times. In the first run the biscuits are browned in the areas in contact with the film. There is no evidence of melting of the film in the seal area. In the second run a part of the film pulls away from the frame, resulting in less contact between the film and certain parts of the biscuits. Those parts of the biscuits not in contact with the film do not brown.

Example 2

A package is prepared as in Example 1, containing 6 biscuits. Instead of sealing the film to the frame as in Example 1, the film is taped to the four sides of the frame using heat resistant tape based on polyimide film. Such tape is available as Scotch TM brand industrial tape 5413 "Kapton", from the 3M Company. ("Kapton" is a registered trademark of Du Pont for polyimide films.) During cooking the tape remains securely attached to the package and maintains good contact between the film and the biscuits, resulting in even browning.

Example 3

A package is prepared having the configuration as shown in FIG. 4, with the cardboard insulator made as a vertical fence around two uncooked biscuits as in Example 1. The film, of the type used in Example 1 is heat sealed and taped to the fence with no areas of overlap from the upper and lower leaves. Upon cooking in the oven of Example 1 for one minute, the biscuits are done and have good texture. (Depending on the composition and extent of expansion of the dough and the exact package configuration, some of the dough may stick to the cardboard fence or may exude through any openings that may appear due to separation of the film from the fence.)

I claim:

1. A microwave cooking package suitable for cooking a food item which requires surface browning or crispening, comprising (a) an upper leaf and a lower leaf formed from at least one heat resistant film, said film having a microwave susceptor material extending over at least a portion of its surface area in an amount to generate sufficient heat under microwave cooking conditions to brown or crispen the surface of said food item placed adjacent thereto, said upper and lower leaves being maintained in proximity with each other in an area about the periphery of such upper and lower leaves so as to form a container of a size and shape suitable for enclosing said food item, wherein said susceptor material extends over at least a portion of the areas in proximity with each other; and (b) a thermally insulating, microwave transparent material to which at least a portion of said susceptor-laden areas in proximity with each other are affixed, whereby direct contact between said portions susceptor-laden areas in proximity with each other is avoided and said portions do not overheat during microwave cooking.

2. The package of claim 1 wherein the insulating material is a layer of cardboard.

3. The package of claim 2 wherein the upper and lower leaves of heat resistant film are sealed to the layer of cardboard.

4. The package of claim 3 wherein the layer of cardboard forms a substantially planar frame encompassing said food item and interposed between the leaves of said film, and wherein the leaves of film are sealed to the frame face to face.

5. The package of claim 1 wherein the insulating material is in the form of a vertical fence to which the upper and lower leaves of heat resistant film are affixed, said leaves abutting each other edge to edge.

6. The package of claim 1 wherein the upper and lower leaves are formed from a single sheet of film, folded over on itself.

7. The package of claim 6 wherein the microwave susceptor material is in a centrally located stripe extending the length of said single sheet of film, perpendicular to the direction of the fold, the upper and lower leaves of the film are sealed together along the areas on the sides of the centrally located stripe and are sealed to the insulating layer at the ends of said stripe.

8. The package of claim 1 wherein the heat resistant film is selected from the group consisting of polyesters, polyarylates, cellophane, cellulose triacetate, ethylene chlorotrifluoroethylene copolymers, fluorinated polyethylene, polytetrafluoroethylene, polycarbonates, polyimides, polyetherimides, polyamides, polysulfones, polyvinyl alcohol polymers, polyetherketones, and polymethylpentene.

9. The package of claim 8 wherein the heat resistant film is polyethylene terephthalate.

10. The package of claim 9 wherein the heat resistant film is a laminate comprising at least one layer of heat stabilized polyethylene terephthalate.

11. The package of claim 1 wherein the microwave susceptor material is aluminum flake embedded within a layer of thermoplastic material.

12. The package of claim 1 wherein the microwave susceptor material is at least one layer of vacuum deposited metal.

13. The package of claim 12 wherein the metal is aluminum.

14. The package of claim 12 wherein the metal is stainless steel.

* * * * *